US008808423B2

(12) United States Patent
Kim et al.

(10) Patent No.: US 8,808,423 B2
(45) Date of Patent: Aug. 19, 2014

(54) MAGNESIUM-BASED ALLOY FOR HIGH TEMPERATURE AND MANUFACTURING METHOD THEREOF

(75) Inventors: Shae K. Kim, Seoul (KR); Jung-Ho Seo, Seoul (KR)

(73) Assignee: Korea Institute of Industrial Technology, Cheonan (KR)

( * ) Notice: Subject to any disclaimer, the term of this patent is extended or adjusted under 35 U.S.C. 154(b) by 529 days.

(21) Appl. No.: 13/051,630

(22) Filed: Mar. 18, 2011

(65) Prior Publication Data

US 2011/0236251 A1 Sep. 29, 2011

(30) Foreign Application Priority Data

Mar. 29, 2010 (KR) ..... 10-2010-0028157
Dec. 27, 2010 (KR) ..... 10-2010-0135979

(51) Int. Cl.
*C22C 23/02* (2006.01)
*C22C 1/02* (2006.01)

(52) U.S. Cl.
CPC .. *C22C 23/02* (2013.01); *C22C 1/02* (2013.01)
USPC ..... 75/604; 420/409; 420/402; 420/410

(58) Field of Classification Search
CPC ..... C22C 23/02; C22C 1/02
USPC ..... 420/409, 402, 410; 75/604
See application file for complete search history.

(56) References Cited

U.S. PATENT DOCUMENTS

| | | | | |
|---|---|---|---|---|
| 4,705,561 | A | 11/1987 | Green | |
| 7,041,179 | B2 * | 5/2006 | Bronfin et al. | 148/420 |
| 2006/0243094 | A1 * | 11/2006 | Bryant et al. | 75/415 |
| 2011/0033333 | A1 * | 2/2011 | Enami et al. | 420/407 |
| 2011/0236250 | A1 * | 9/2011 | Kim et al. | 420/407 |

FOREIGN PATENT DOCUMENTS

| | | | |
|---|---|---|---|
| JP | 4467641 | B2 | 5/2010 |
| KR | 1020060094734 | A | 8/2006 |
| KR | 1020090071903 | A | 7/2009 |
| WO | WO 2010/032893 | A1 | 3/2010 |

OTHER PUBLICATIONS

Machine translation of KR1020050016143A1, Aug. 2006.*
Jin-Kyu Lee et al., "Development of Eco-Mg Alloy", Journal of the Korean Foundrymen's Society, Jun. 2009, vol. 29 No. 3.

* cited by examiner

*Primary Examiner* — Jie Yang

(57) ABSTRACT

Provided is a manufacturing method of a magnesium-based alloy for high temperature. The manufacturing method includes melting a magnesium (Mg) or magnesium alloy into a liquid phase, adding calcium oxide (CaO) 1.4 times the weight of a final calcium (Ca) target composition onto a surface of a melt in which the magnesium or the magnesium alloy is melted, forming a targeted amount of Ca in the magnesium or magnesium alloy through a reduction reaction between the melt and the added CaO. Specifically, the amount of Ca formed is in the range of 0.8 wt % to 2.4 wt %, and a final composition of the Mg alloy includes 6.0-8.0 wt % of aluminum (Al), 0.1-0.3 wt % of manganese (Mn), 0.2-0.3 wt % of strontium (Sr), less than 0.04 wt of zinc (Zn), less than 0.9 wt of tin (Sn), and a balance being Mg.

7 Claims, 19 Drawing Sheets

Mg Ka1_2

Al Ka1

Ca Ka1

MAGNESIUM-BASED ALLOY FOR HIGH TEMPERATURE AND MANUFACTURING METHOD THEREOF

BACKGROUND OF THE INVENTION

1. Field of the Invention

The present invention relates to a magnesium-based alloy for high temperature and a manufacturing method thereof.

2. Description of the Prior Art

Magnesium with a specific gravity of 1.7 is not only the lightest element among commercially available metals, but its specific strength and specific stiffness are also superior to those of iron and aluminum. In addition, excellent mechanical properties can be obtained when manufacturing magnesium products by a die casting process. Therefore, magnesium is currently being applied to various fields, such as portable electronic components, aircrafts and sporting goods, etc., with mainly focusing on the field of automobile components. When magnesium alloys are applied to the automobile components, 30% of a weight reduction can be achieved.

Typical magnesium alloys among the currently available commercial magnesium alloys for die casting applications are magnesium (Mg)-aluminum (Al) based alloys such as AZ91D, AM50 and AM60. These magnesium alloys are low priced and have good castability as compared to other alloys for the die casting applications. Particularly, high strength can be obtained by forming a $\beta$-$Mg_{17}Al_{12}$ phase during solidification at room temperature. However, while automobile and aircraft components are generally used in a high temperature environment of 150-200° C., poor thermal stability of the $\beta$ phase deteriorates creep resistance of these magnesium alloys. As a result, there is a disadvantage that these magnesium alloys are not appropriate for applying to the foregoing products used in the high temperature environment.

Many efforts have been made to develop and optimize magnesium alloys for high temperature since the 1990's. Magnesium alloys for high temperature are largely classified into magnesium alloys for die casting applications and magnesium alloys for sand casting applications, which depend on alloy compositions and manufacturing methods caused by differences in use temperatures of target components. A proper characteristic required for the magnesium alloy for high temperature is castability that is appropriate for die casting, and corrosion and oxidation resistances are also required. In addition, when considering competitiveness against steel and aluminum, development of magnesium alloys excluding high-priced additive elements is required in terms of cost.

When examining conventionally developed magnesium alloys for high temperature based on the above requirements, magnesium alloys having high addition ratios of rare earth elements (RE) are disadvantageous in an aspect of cost. On the other hand, when adding alkaline earth metals (e.g., calcium (Ca) and strontium (Sr)) into magnesium alloys, there is a problem that the magnesium alloys have poor castability such as decrease in melt fluidity, hot tear cracks, and die soldering.

SUMMARY OF THE INVENTION

The present invention provides a magnesium-based alloy for high temperature and a manufacturing method thereof, in which an oxide form of Ca (a widely known alloying element for magnesium), i.e., calcium oxide (CaO) is added into a molten magnesium to reduce the CaO, the reduced Ca from the CaO reacts with Mg or Al to form a phase, and formation of a thermally unstable $\beta$-$Mg_{17}Al_{12}$ phase can be suppressed so that high-temperature strength and deformation resistance can be improved.

The present invention also provides a magnesium-based alloy for high temperature and a manufacturing method thereof, in which an alkaline earth metal oxide, i.e., CaO is added into the magnesium alloy such that ductility and strength can be improved at the same time by improving internal soundness of casting such as reduction of oxides, inclusions and pores or the like. In Mg alloys, use of each Mg alloy is generally determined according to the temperature of an environment where products are used. The use environment temperature is often classified into 90° C., 120° C. and 150° C., etc. The present invention also provides a magnesium-based alloy for high temperature which can be used at high temperatures of 120° C. or more and 175° C. or more including a temperature of 90° C. or more.

The object of the present invention is not limited to the aforesaid, and other objects not described herein will be clearly understood by those skilled in the art from descriptions below.

In accordance with an exemplary embodiment of the present invention, a method of manufacturing a magnesium-based alloy for high temperature includes: melting magnesium (Mg) or magnesium alloy into a liquid phase; adding 0.5% to 4.0% by weight of calcium oxide (CaO) onto a surface of a melt in which the magnesium or magnesium alloy is melted; exhausting the CaO to allow the CaO not to at least substantially remain in the magnesium or magnesium alloy through a surface reduction reaction between the melt and the CaO; and forming a compound by reacting at least a portion of calcium (Ca) produced by the surface reduction reaction in the magnesium or magnesium alloy.

Specifically, the method may include adding the CaO 1.4 times the weight of a final Ca target composition onto the surface of the melt in which the magnesium or the magnesium alloy is melted.

The CaO may be added in the range of 1.0-3.5 wt %. The Ca may be produced in the range of 0.8-2.4 wt %.

A final composition of the Mg alloy may include 6.0-8.0 wt % of aluminum (Al), 0.1-0.3 wt % of manganese (Mn), 0.2-0.3 wt % of strontium (Sr), less than 0.04 wt % of zinc (Zn), less than 0.9 wt % of tin (Sn), and a balance being Mg.

The compound formed may include at least one of $Mg_2Ca$, $Al_2Ca$ and $(Mg, Al)_2Ca$.

In accordance with another exemplary embodiment of the present invention, a magnesium-based alloy for high temperature is characterized by that the magnesium-based alloy is manufactured by adding 0.5% to 4.0% by weight of CaO into a molten magnesium or magnesium alloy, and partially or wholly exhausting the CaO through a surface reduction reaction of the CaO, wherein the magnesium-based alloy contains a compound formed through combination of Ca with Mg or other alloying elements in the magnesium-based alloy to thereby have larger high-temperature mechanical properties as compared to a Mg alloy having the same composition manufactured by directly adding Ca.

The high-temperature mechanical properties may be high-temperature yield strength or high-temperature tensile strength.

The CaO may be added in the range of 1.0-3.5 wt %. The Ca may be produced in the range of 0.8-2.4 wt %.

A final composition of the Mg alloy may include 6.0-8.0 wt % of Al, 0.1-0.3 wt % of Mn, 0.2-0.3 wt % of Sr, less than 0.04 wt % of Zn, less than 0.9 wt % of Sn, and a balance being Mg.

The compound formed may include at least one of $Mg_2Ca$, $Al_2Ca$ and $(Mg, Al)_2Ca$.

In accordance with still another exemplary embodiment of the present invention, a magnesium-based alloy for high temperature is characterized by that the magnesium-based alloy is manufactured by adding 0.5% to 4.0% by weight of CaO into a molten magnesium or magnesium alloy, and partially or wholly exhausting through a reduction reaction of the CaO, wherein the magnesium-based alloy contains a compound formed through combination of Ca with Mg or other alloying elements in the magnesium-based alloy to thereby have lower high-temperature elongation and high-temperature creep strain as compared to a Mg alloy having the same composition manufactured by directly adding Ca.

The CaO may be added in the range of 1.0-3.5 wt %. The Ca may be produced in the range of 0.8-2.4 wt %.

A final composition of the Mg alloy may include 6.0-8.0 wt % of aluminum (Al), 0.1-0.3 wt % of manganese (Mn), 0.2-0.3 wt % of strontium (Sr), less than 0.04 wt % of zinc (Zn), less than 0.9 wt % of tin (Sn), and a balance being Mg.

The compound formed may include at least one of $Mg_2Ca$, $Al_2Ca$ and $(Mg, Al)_2Ca$.

In accordance with yet another exemplary embodiment of the present invention, A magnesium-based alloy for high temperature is characterized by that the Mg-based alloy is manufactured through addition of CaO into a molten magnesium or magnesium alloy and a surface reduction reaction of the CaO, wherein strength and elongation of room-temperature mechanical properties are increased at the same time as compared to a Mg alloy having the same composition manufactured by directly adding Ca.

As described above, according to the present invention, when CaO is added to a commercially available magnesium alloy, microstructure of the magnesium alloy becomes finer, and $Al_2Ca$ phases or the like are formed. Also, formation of a thermally unstable $\beta$-$Mg_{17}Al_{12}$ phase is suppressed, and casting defects are greatly reduced. As a result, yield strength and tensile strength of the magnesium alloy at high temperature are increased, and an abrupt increase in elongation at high temperature is also suppressed unlike in typical magnesium alloys.

Also, high-temperature creep strain is reduced by suppressing deformation at high temperature. Therefore, high-temperature creep resistance is increased.

BRIEF DESCRIPTION OF THE DRAWINGS

Exemplary embodiments can be understood in more detail from the following description taken in conjunction with the accompanying drawings, in which.

DETAILED DESCRIPTION OF THE INVENTION

Figure 1:
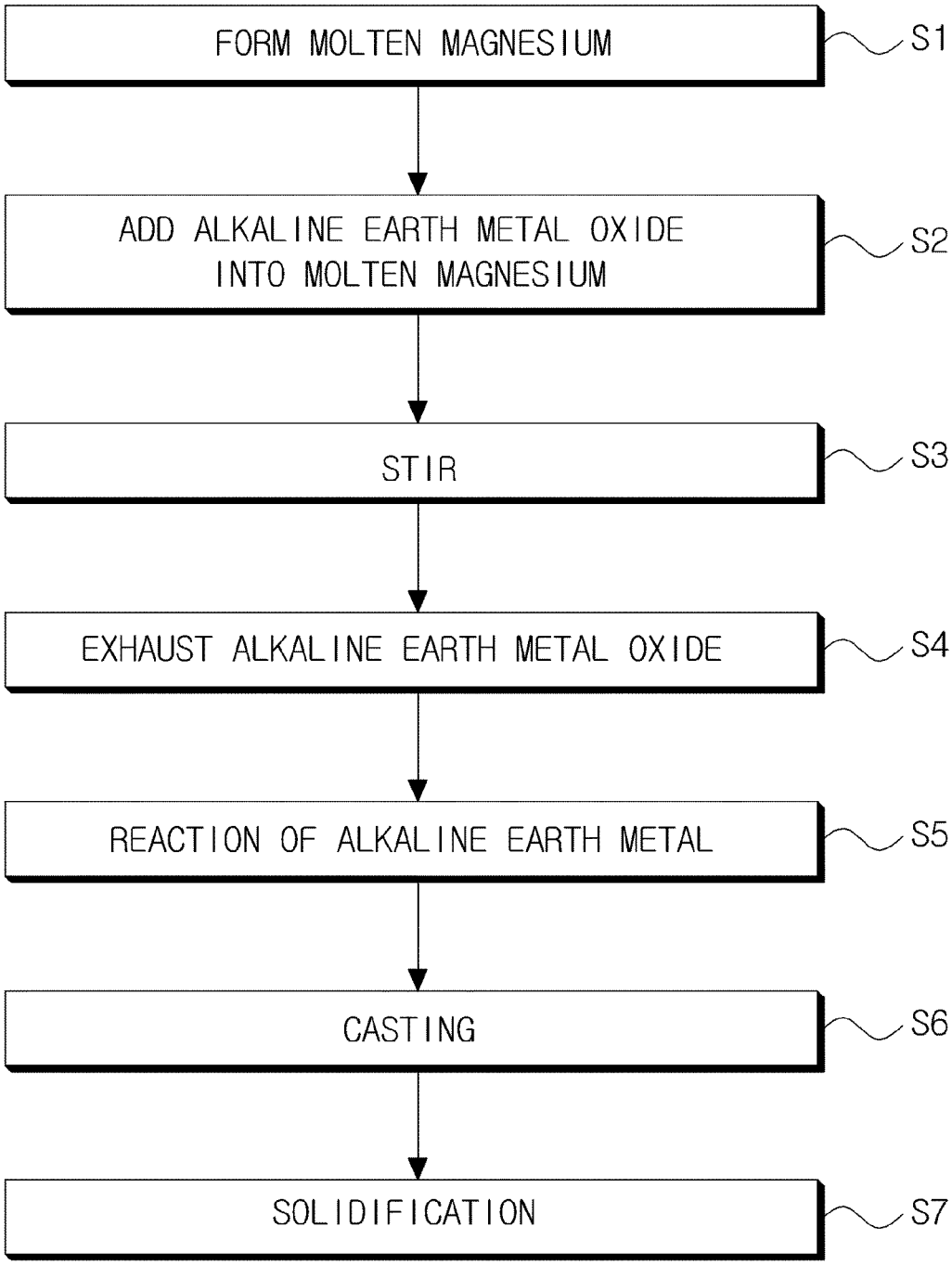
FIG. 1 is a flowchart illustrating a manufacturing method of a magnesium-based alloy according to the present invention.

Preferred embodiments of the present invention will be described below in more detail with reference to the accompanying drawings. In every possible case, like reference numerals are used for referring to the same or similar elements in the description and drawings. Moreover, detailed descriptions related to well-known functions or configurations will be ruled out in order not to unnecessarily obscure subject matters of the present invention.

In the present invention, a manufacturing method of a new alloy by adding CaO into molten magnesium and an alloy thereof are used to solve problems arising when calcium is added to magnesium and overcome limitations of physical properties.

FIG. 1 is a flowchart illustrating a manufacturing method of a magnesium-based alloy according to the present invention. As shown in FIG. 1, the manufacturing method of the magnesium-based alloy according to the present invention includes the steps of: forming a magnesium-based melt (S1);

adding an alkaline earth metal oxide (CaO in the present invention) (S2); stirring the magnesium-based melt (S3); exhausting the alkaline earth metal oxide (S4); allowing the alkaline earth metal (Ca in the present invention) to react with the magnesium-based melt (S5); casting (S6); and solidifying (S7). Although step S4 of exhausting the alkaline earth metal oxide and step S5 of allowing the alkaline earth metal to react with the magnesium-based melt are divided into the separate steps for convenience of description, two steps S4 and S5 occur almost at the same time. That is, when supplying of the alkaline earth metal starts in step 4, step S5 is initiated In step S1 of forming the magnesium-based melt, magnesium or a magnesium alloy are put into a crucible, and heated at a temperature ranging from 400° C. to 800° C. under a protective gas atmosphere. Then, the magnesium alloy in the crucible is melted to form the magnesium-based melt.

Melting Temperature of Magnesium or Magnesium Alloy

In the present invention, temperature for melting magnesium or a magnesium alloy means the melting temperature of pure magnesium and the melting temperature of the magnesium alloy. The melting temperatures may be different depending on alloy type. For a sufficient reaction, CaO is added in the state where magnesium or the magnesium alloy is completely melted. A temperature at which a solid phase is sufficiently melted to exist in a complete liquid phase is enough for the melting temperature of magnesium or the magnesium alloy. However, in the present invention, work is necessary to maintain a molten magnesium in the temperature range with sufficient margin by considering the fact that the temperature of the molten magnesium is decreased due to the addition of CaO.

Herein, when the temperature is less than 400° C., the molten magnesium alloy is difficult to be formed. On the contrary, when the temperature is more than 800° C., there is a risk that the magnesium-based melt may be ignited. A molten magnesium is generally formed at a temperature of 600° C. or more, whereas a molten magnesium alloy may be formed at a temperature ranging from 400° C. or more to 600° C. or less. In general, many cases in metallurgy show that a melting point decreases as alloying proceeds.

When the melting temperature is increased too high, vaporization of liquid metal may occur. Also, magnesium easily ignites due to its own characteristic so that the molten magnesium may be lost and an adverse effect may be exerted on final physical properties.

The magnesium used in step S1 of forming the magnesium-based melt may be any one selected from pure magnesium, a magnesium alloy, and equivalents thereof. Also, the magnesium alloy may be any one selected from AZ91D, AM20, AM30, AM50, AM60, AZ31, AS41, AS31, AS21X, AE42, AE44, AX51, AX52, AJ50X, AJ52X, AJ62X, MRI153, MRI 230, AM-HP2, magnesium-Al, magnesium-Al—Re, magnesium-Al—Sn, magnesium-Zn—Sn, magnesium-Si, magnesium-Zn—Y, and equivalents thereof; however, the present invention is not limited thereto. Any magnesium alloy that is generally available in industries may be used.

In step S2 of adding the alkaline earth metal oxide, CaO in the form of powder is added into the molten magnesium. Here, it is preferable that CaO is in the powder form for accelerating a reaction with the magnesium alloy.

Powder Form of CaO

Any form of CaO may be input for the reaction. Desirably, CaO may be added in a powder state so as to increase a surface area for efficient reaction. However, if the additive is too fine, that is, less than 0.1 μm in size, the additive is liable to be scattered by vaporized magnesium or hot wind, thereby making it difficult to input the additive into a furnace. Further, the additives are agglomerated each other, and thus clustered while not being easily mixed with liquid molten metal. On the contrary, if the powder is too coarse, it is undesirable because a total surface area is not increased. It is preferable that an ideal particle size should not exceed 500 μm. More preferably, the particle size may be 200 μm or less.

In order to prevent powder phases from being scattered, it is possible to input CaO in the form of pellet that is agglomerated from the powder form.

Added Alkaline Earth Metal Oxide (Calcium Oxide)

In the present invention, CaO is used as an alkaline earth metal oxide added into the molten magnesium. In addition, any one selected from strontium oxide (SrO), beryllium oxide (BeO), magnesium oxide (MgO), and equivalents thereof may be used as the alkaline earth metal oxide.

The alkaline earth metal oxide, which is used in step S2 of adding the alkaline earth metal oxide, may be generally added in the range of 0.001 wt % to 30 wt %.

An input amount of the alkaline earth meal oxide is determined by a final target alloy composition. That is, an amount of CaO may be determined by performing a back-calculation according to a desired amount of Ca to be alloyed into a magnesium alloy. Since physical properties of the magnesium alloy deviate from its original physical properties when the amount of Ca, which is indirectly alloyed into the magnesium alloy from the CaO, exceeds 21.4 wt % (30 wt % in the case of CaO), it is preferable that the input amount of CaO should be adjusted to 30 wt % or less.

According to the magnesium alloy for high temperature and the manufacturing method thereof according to the present invention, the input amount of the alkaline earth metal oxide is in the range of 0.5 wt % to 4.0 wt %. Excellent high-temperature mechanical properties could be obtained when the input amount of the alkaline earth metal oxide was 4.0 wt % or less. Improvement of the above properties was not relatively large when the input amount was less than 0.5 wt %. More preferably, the composition is in the range of 1.0 wt % to 3.5 wt %. Herein, the excellent high-temperature mechanical properties mean relatively high yield strength and tensile strength at high temperature, and relatively low elongation and creep strain. at high temperature.

In the present invention, it is more preferable that the input amount of calcium oxide (CaO) should be adjusted such that calcium formed by reduction of CaO is included in the range of 0.8 wt % to 2.4 wt % in the final magnesium alloy.

In step S3, the molten magnesium is stirred for 1 second to 60 minutes per 0.1 wt % of the added CaO.

Here, if the stirring time is less than 1 second per 0.1 wt %, the CaO is not mixed with the molten magnesium sufficiently; and, if the stirring time is more than 60 minutes per 0.1 wt %, the stirring time of the molten magnesium may be unnecessarily lengthened. In general, the stirring time depends on the volume of the molten magnesium and the input amount of CaO.

The oxide powders of a required amount may be input at once. However, to accelerate the reaction and reduce agglomeration possibility, it is preferable that the oxide powders be re-input after a predetermined time elapses from a first input time, or the oxide powders are grouped into several batches of appropriate amounts and the batches are input in sequence.

Stirring Method and Conditions

It is preferable to stir the molten magnesium for the efficient reaction between the magnesium or magnesium alloy and the calcium oxide in the present invention. The stirring may be generally performed by generating an electromagnetic field using a device capable of applying electromagnetic fields around the furnace holding the molten magnesium, thus enabling the convection of the molten magnesium to be induced. Also, artificial stirring (mechanical stirring) may be performed on the molten magnesium from the outside. In the case of mechanical stirring, the stirring may be performed in such a manner that the inputted CaO powders are not agglomerated. The ultimate purpose of the stirring in the present invention is to induce the reduction reaction between the molten magnesium and added powders properly.

The stirring time may vary with the temperature of a molten metal and the state (pre-heating state or the like) of powders added. Preferably, the stirring may continue to be performed in principle until the powders are not observed on the surface of the molten magnesium. Since the powders are lower in specific gravity than the molten magnesium so that they float on the molten magnesium in a steady state, it can be indirectly determined that the powders and the molten magnesium sufficiently react when the powders are not observed on the molten magnesium any longer. Herein, the term 'sufficiently react' means that all of the CaO powders substantially react with the molten magnesium and are exhausted.

Although the CaO powders are not observed on the molten magnesium, possibilities of existing in the molten magnesium may not be excluded. Therefore, the CaO powders that do not float yet should be observed for a predetermined holding time after the stirring time, and the holding time may be necessary to complete the reaction of the CaO powders that did not react with the molten magnesium yet.

Stirring Time

The stirring is effective when it is performed at the same time with the input of the oxide powders. In addition, the stirring may start after the oxide powders receive heat from the molten magnesium and reach a predetermined temperature or higher, which enables acceleration of the reaction. The stirring continues to be performed until the added oxide powders are not observed on the surface of the molten magnesium. After the calcium oxide is completely exhausted through the reaction, the stirring is finished.

Surface Reaction

In general, when Ca and Sr of the alkaline earth metals are directly added into the molten magnesium, reactions occur as Ca and Sr sink into the molten magnesium having low specific gravity. Therefore, alloying may be completed by simply stirring the molten magnesium to help dissolution of Ca.

On the other hand, when the calcium oxide is input into the molten magnesium, the calcium oxide does not sink into the molten magnesium but float on the surface of the molten magnesium due to a difference in specific gravity.

In the case of typical metal alloying, it is in general that reactions are forced to occur in a molten metal by inducing an active reaction by convection or stirring of the molten metal and alloying metal elements. However, in the present invention, when the reaction was induced actively, the oxide inputted into the molten magnesium hardly reacted and left in the final material so that physical properties were deteriorated or it acted as the cause of defects. That is, when the reaction was induced inside the molten magnesium instead of on the surface of the molten magnesium, there were relatively more cases where the calcium oxide remained in the final molten magnesium rather than reacted on the surface of the molten magnesium.

Therefore, in the present invention, it is important to create a reaction environment where the oxide reacts on the surface rather than inside the molten magnesium. To this end, it is important not to forcibly stir the oxide floating on the surface of the molten magnesium into the molten magnesium. It is important to uniformly spread the calcium oxide on the molten magnesium surface exposed to air. More preferably, it is important to supply the oxide in such a way as to coat the entire surface of the molten magnesium with the oxide.

Reaction occurred better in the case of stirring the molten magnesium, and also reaction occurred better when the stirring is performed at an outer surface (surface of an upper layer portion) rather than inside the molten magnesium. That is, the molten magnesium reacted better with the oxide powders exposed to air at the outer surface (surface of an upper layer portion) thereof. However, results were not satisfactory under a state of vacuum or ambient gas. For sufficient reaction, it is necessary to induce the surface reaction through stirring of the upper layer portion. Herein, the term 'sufficiently react' means that all of the additive powders substantially react with the molten magnesium and are exhausted. In the present invention, the stirring inducing the foregoing surface reaction is denoted as surface stirring. That is, Ca, which is produced by a reduction reaction (surface reduction reaction) of the CaO added onto the surface of the molten Mg, acts as an alloying element of Mg or Mg alloys.

In Table 1 below, after adding 5 wt %, 10 wt % and 15 wt % of calcium oxide having a particle size of 70 μm into a molten AM60B magnesium alloy, respectively, residual amounts of the calcium oxide in the magnesium alloy according to stirring methods were measured.

The stirring methods used herein were the stirring of the upper layer portion of molten magnesium alloy, the stirring of the inside of the molten magnesium alloy, and the rest method was no stirring. According to various stirring conditions, when comparing the case of the stirring of only the upper layer portion with the cases of no stirring and the stirring of the inside of the molten magnesium alloy, the smallest residual amount of the calcium oxide was observed in the case of the stirring of only the upper layer portion, that is, the final residual amounts of the calcium oxide were 0.001 wt %, 0.002 wt % and 0.005 wt % as the calcium oxide was added 5 wt %, 10 wt % and 15 wt %, respectively. That is, it can be understood that when the upper layer portion of molten magnesium alloy is stirred to allow CaO to react at the outer surface of the molten magnesium, most of CaO is decomposed into Ca. That is, Ca was added into the alloy by inducing the reduction reaction through further addition of CaO into the commercially available AM60B alloy.

TABLE 1

| | | Addition of 5 wt % of CaO | Addition of 10 wt % of CaO | Addition of 15 wt % of CaO |
|---|---|---|---|---|
| Residual amount of CaO in the alloy | No stirring | 4.5 wt % CaO | 8.7 wt % CaO | 13.5 wt % CaO |
| | Stirring the inside of the molten magnesium alloy | 1.2 wt % CaO | 3.1 wt % CaO | 5.8 wt % CaO |
| | Stirring the upper layer portion of the molten magnesium alloy (present invention) | 0.001 wt % CaO | 0.002 wt % CaO | 0.005 wt % CaO |

An oxygen component of the calcium oxide is substantially removed above the surface of the molten magnesium alloy by the stirring the upper layer portion of molten magnesium alloy. It is desirable that the stirring is performed at an upper layer portion of which a depth is 20% of a total depth of the molten magnesium from the surface. If the depth is beyond 20%, the surface reaction according to a preferred example of the present invention is rarely generated. More preferably, the stirring may be performed in an upper layer portion of which a depth is 10% of the total depth of the molten magnesium from the surface. The substantially floating calcium oxide is induced to be positioned in an upper layer portion of which a depth is 10% of an actual depth of the molten magnesium, thereby minimizing the turbulence of the molten magnesium.

In step S4 of exhausting the alkaline earth metal oxide, through the reaction between the molten magnesium and the added calcium oxide, the calcium oxide is completely exhausted so as not to remain in the magnesium alloy at least partially or substantially. It is preferable that all the calcium oxide inputted in the present invention is exhausted by a sufficient reaction. However, even if some portions do not react and remain in the alloy, it is also effective if these do not largely affect physical properties.

Herein, the exhausting of calcium oxide includes removing an oxygen component from the alkaline earth metal oxide. The oxygen component is removed in the form of oxygen gas ($O_2$) or in the form of dross or sludge through combination with magnesium or alloying components in the molten magnesium. The oxygen component is substantially removed out from the top surface of the molten magnesium by stirring the upper layer portion of the molten magnesium.

Figure 3:
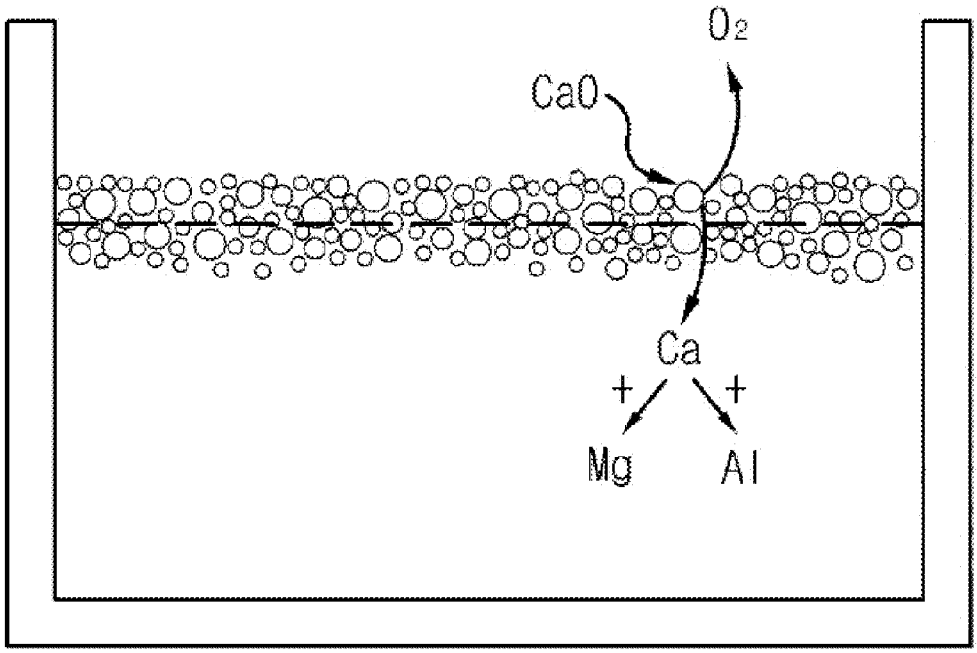
FIG. 3 is a schematic view exemplarily showing dissociation of an alkaline earth metal oxide (CaO) through stirring of an upper layer portion of molten magnesium according to the present invention.

FIG. 3 is a schematic view exemplarily showing dissociation of calcium oxide through stirring of an upper layer portion of molten magnesium according to the present invention.

In step S5 of allowing the alkaline earth metal to react with the molten magnesium, calcium produced by the exhaustion of the calcium oxide reacts with the molten magnesium alloy so as not to at least partially or substantially remain in the magnesium alloy. This means that the calcium produced by the exhaustion is compounded with at least one of magnesium, aluminum, and other alloying elements (components) in the magnesium alloy, and is thus not left remaining substantially. Here, a compound refers to an intermetallic compound obtained through bonding between metals.

In the end, the added calcium oxide is partially or substantially exhausted by removing the oxygen component through the reaction with the magnesium alloy, i.e., the molten magnesium alloy, and the produced calcium makes a compound with at least one of magnesium in the magnesium alloy, aluminum, and other alloying elements in the molten magnesium alloy. Therefore, the formed calcium will not remain at least partially or substantially in the magnesium alloy.

In step 5 of exhausting the alkaline earth metal oxide, there occur many flint flashes during the reduction reaction of the alkaline earth metal oxide on the surface of the molten magnesium. The flint flashes may be used as an index for confirming whether the reduction reaction is completed or not. In the case of terminating the reaction by tapping the molten magnesium while the flint flashes are being generated, the alkaline earth metal oxide added may not be fully exhausted. That is, the tapping of the molten magnesium is performed after the flint flashes, which can be used as an index for indirectly measuring the reduction reaction, disappear.

Figure 2:
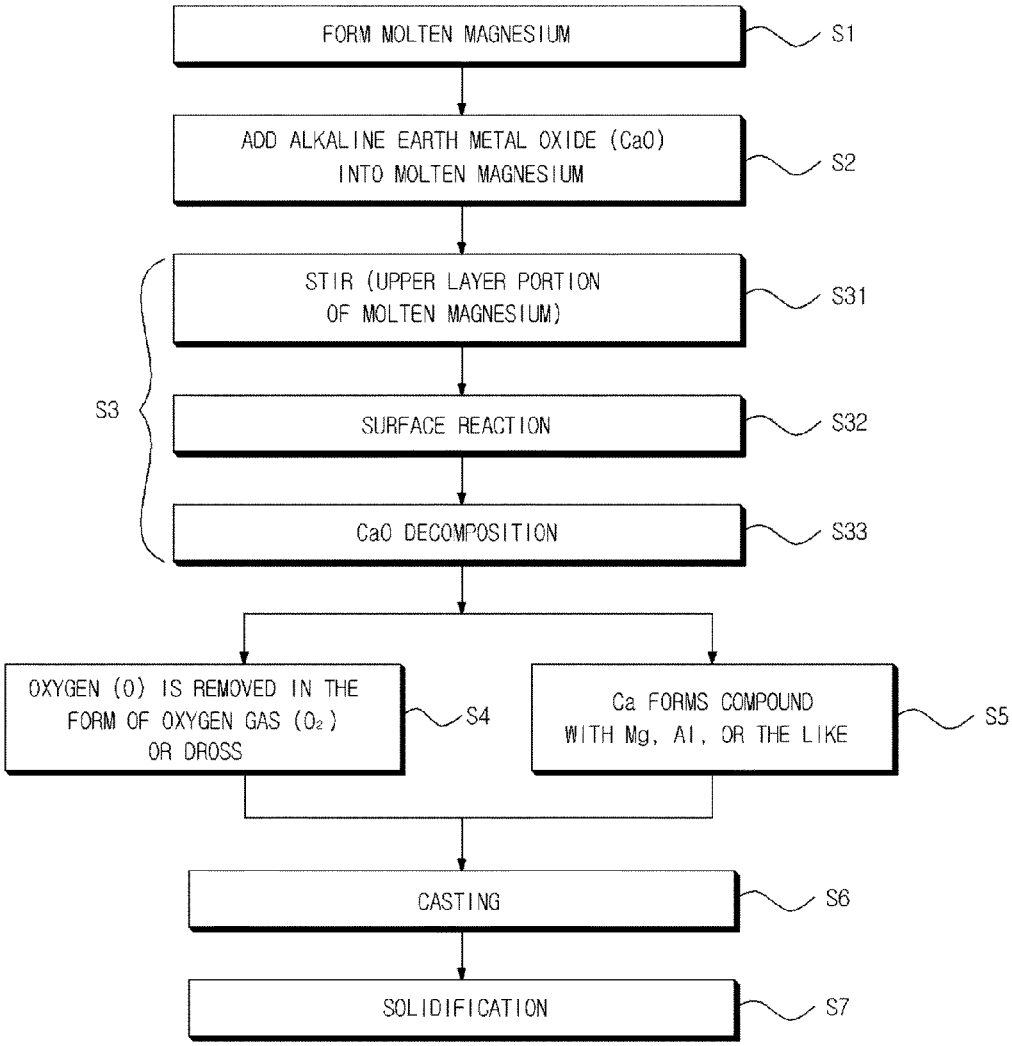
FIG. 2 is a flowchart illustrating dissociation of an alkaline earth metal oxide (CaO) added into molten magnesium according to the present invention.

Processes described until now are illustrated in FIGS. 1 and 2. FIG. 2 is a flowchart illustrating dissociation of calcium oxide used to be added into a molten magnesium according to the present invention.

In the casting step S6, casting is performed by putting the molten magnesium into a mold at room temperature or in a pre-heating state. Herein, the mold may include any one selected from a metallic mold, a ceramic mold, a graphite mold, and equivalents thereof. Also, the casting method may include gravity casting, continuous casting, and equivalent methods thereof.

In the solidifying step S7, the mold is cooled down to room temperature, and thereafter, the magnesium alloy (e.g., magnesium alloy ingot) is taken out from the mold.

The magnesium-based alloy formed by the above-described manufacturing method may have hardness (HRF) of 40 to 80. However, the hardness value may change widely depending on processing methods and heat treatment or the like, and thus the magnesium-based alloy according to the present invention is not limited to thereto.

In pure molten magnesium, magnesium in the molten magnesium reacts with alkaline earth metal to thereby form a magnesium (alkaline earth metal) compound. In the present invention, when the alkaline earth metal oxide is CaO, $Mg_2Ca$ is formed. Oxygen constituting CaO is discharged out of the molten magnesium in the form of oxygen gas ($O_2$), or combines with Mg to be MgO and is then discharged in the form of dross (see Reaction Formula 1 below).

Pure Mg+CaO->Mg (Matrix)+$Mg_2Ca$ . . . [$O_2$ produced+MgO dross produced] Reaction Formula 1

In a molten magnesium alloy, magnesium in the molten magnesium alloy reacts with alkaline earth metal to thereby form a magnesium (alkaline earth metal) compound or an aluminum (alkaline earth metal) compound. Also, an alloying element reacts with alkaline earth metal to form a compound together with magnesium or aluminum. In the present invention, when the alkaline earth metal oxide is CaO, $Mg_2Ca$, $Al_2Ca$, or (Mg, Al, other alloying element)$_2$Ca is formed. Oxygen constituting CaO is discharged out of the molten magnesium in the form of oxygen gas ($O_2$) as in the pure Mg case, or combines with Mg to be MgO, which is discharged in the form of dross (see Reaction Formula 2 below).

Mg Alloy+CaO->Mg Alloy (Matrix)+{$Mg_2Ca$+$Al_2Ca$+(Mg, Al, other alloying element)$_2$Ca} . . . [$O_2$ produced+MgO dross produced] Reaction Formula 2

As described above, the present invention makes it possible to manufacture a magnesium alloy economically when compared to related art methods of manufacturing a magnesium alloy.

An alkaline earth metal (e.g., Ca) is relatively a high-priced alloying element as compared to an alkaline earth metal oxide (e.g., CaO), and thus it acts as a main factor of increasing the price of magnesium alloys. Also, alloying is relatively easy by adding alkaline earth metal oxide into magnesium or magnesium alloy instead of adding alkaline earth metal. On the other hand, alloying effects equal to or greater than the case of directly adding alkaline earth metal (e.g., Ca) can be achieved by adding the chemically stable alkaline earth metal oxide (e.g., CaO). That is, Ca, which is produced by the reduction reaction of the CaO added into the molten Mg, acts as an alloying element of Mg or the Mg alloy.

Also, dissolution of the alkaline earth metal in the magnesium alloy occurs in a certain amount when the alkaline earth metal is directly input into magnesium or the magnesium alloy. On the other hand, in the case of applying technology of the present invention, dissolution is absent or extremely small during the addition of the alkaline earth metal oxide (CaO) when comparing degree of the dissolution with the case of directly adding the alkaline earth metal. It was confirmed that an intermetallic compound including an $Al_2Ca$ phase forms much easier when Ca is indirectly added through CaO as compared to the case of directly adding Ca. Therefore, in order to improve physical properties of the magnesium alloy, addition of more than a certain fraction of the alkaline earth metal is required. On the other hand, in the case of manufacturing the magnesium alloy by adding the alkaline earth metal oxide, it can be observed that the physical properties are more improved than the case of directly adding Ca due to the fact that a considerable amount of alkaline earth metal produced from the alkaline earth metal oxide forms intermetallic compounds with Mg or Al (e.g., $Mg_2Ca$ or $Al_2Ca$). It was confirmed that 95% or more of the intermetallic compounds including $Al_2Ca$ forms at grain boundaries and the rest of less than 5% forms in the grains.

Figure 4A:
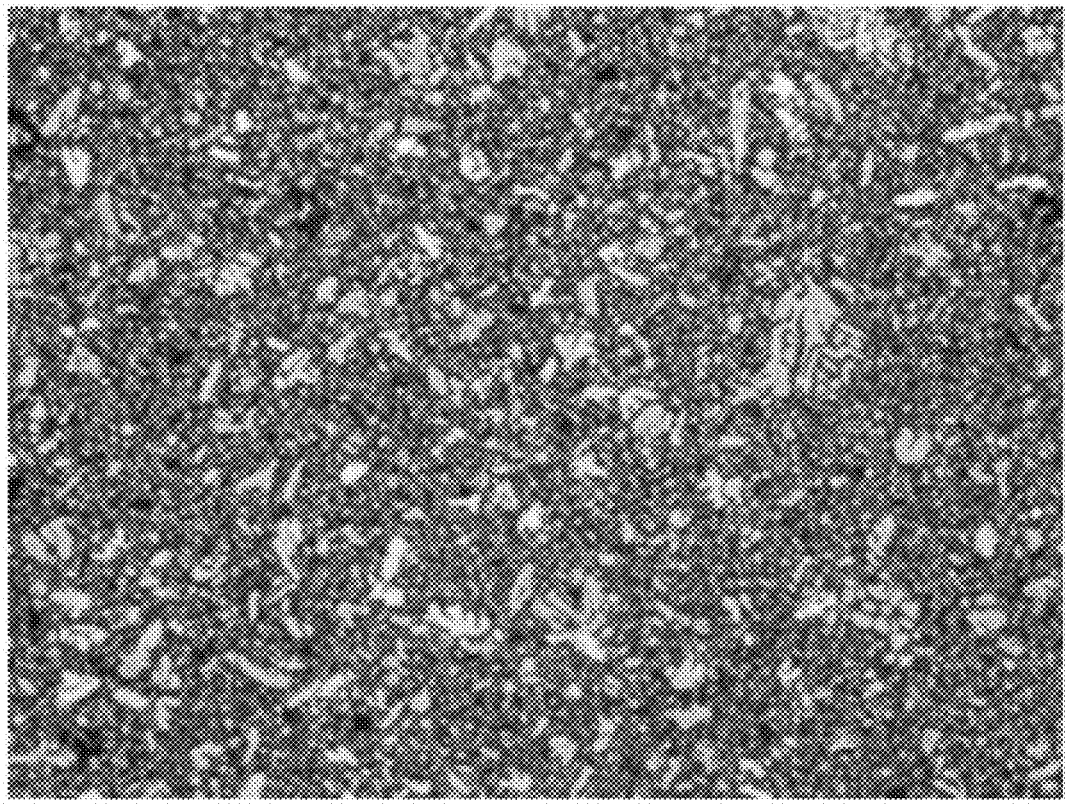
FIG. 4*a* is a micrograph of a commercially available MRI153 alloy.
Figure 4B:
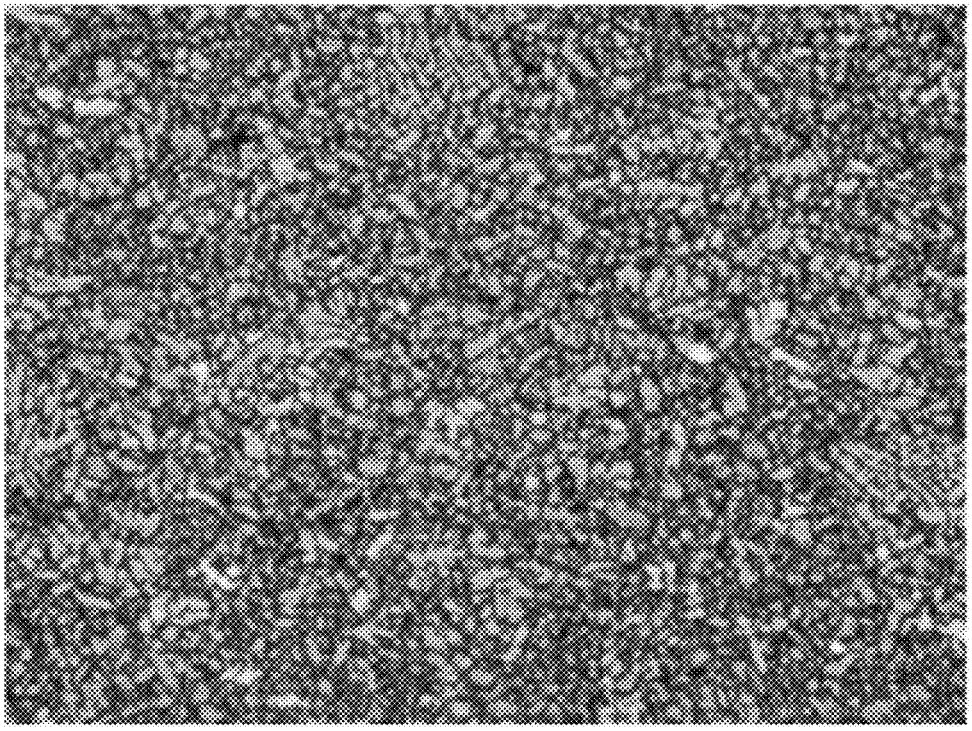
FIG. 4*b* is a micrograph of an Eco-MRI153 alloy manufactured using CaO according to the present invention.

FIG. 4*a* is a micrograph of a commercially available MRI153 magnesium alloy, and FIG. 4*b* is a micrograph of an Eco-MRI 153 alloy manufactured according to the present invention. Herein, the Eco-MRI 153 alloy denotes a magnesium alloy in which CaO is added instead of Ca for obtaining the Ca content equivalent to the commercially available MRI153 magnesium alloy and the corresponding Ca content is alloyed into the magnesium alloy using the reduction reaction. The meaning of 'CaO addition' in the present invention implies that the reduction reaction process is undergone after the addition of the CaO.

For an embodiment of a magnesium-based alloy for high temperature, the final Ca content was formed to 0.98 wt % using the reduction reaction by adding the CaO into the molten magnesium or the magnesium alloy. Then, an alloy having an equivalent composition to the commercially available MRI153 magnesium alloy was manufactured by adjusting other alloying compositions including 7.95 wt % of aluminum (Al), 0.20 wt % of manganese (Mn), 0.27 wt % of strontium (Sr), less than 0.01 wt % of zinc (Zn), and less than 0.01 wt % of tin (Sn).

Herein, the composition of the commercially available MRI153 magnesium alloy includes 7.95 wt % of Al, 0.98 wt % of Ca, 0.20 wt % of Mn, 0.27 wt % of Sr, less than 0.01 wt % of Zn, and less than 0.01 wt % of Sn. A comparative example was manufactured to have the MRI153 alloy composition by directly adding Ca.

Comparing with FIGS. 4*a* and 4*b*, it can be observed that the MRI153 magnesium alloy (Eco-MRI153) manufactured by the CaO addition has a finer microstructure than the commercially available MRI153 magnesium alloy manufactured through the direct addition of Ca and also, casting defects almost do not exist.

For another embodiment, the final Ca content is formed to 2.25 wt % using the reduction reaction by adding the CaO into the molten magnesium or the magnesium alloy. An alloy (Eco-MRI230) having an equivalent composition to the commercially available MRI230 magnesium alloy was manufactured by adjusting other alloying compositions including 6.45 wt % of Al, 0.27 wt % of Mn, 0.25 wt % of Sr, less than 0.01 wt % of Zn, and less than 0.84 wt % of Sn. Herein, the composition of the commercially available MRI230 magnesium alloy includes 6.45 wt % of Al, 2.25 wt % of Ca, 0.27 wt % of Mn, 0.25 wt % of Sr, less than 0.01 wt % of Zn, less than 0.84 wt % of Sn, and a balance being Mg. A comparative example was manufactured to have the MRI230 alloy composition by directly adding Ca.

In the two MRI230 alloys (the Eco-MRI230 and the commercial MRI230), it can also be understood that the Eco-MRI230 has a finer microstructure than the commercially available MRI230 magnesium alloy and casting defects almost do not exist like in the above embodiment.

The final composition of the Mg alloy in the present invention may be adjusted within the range including upper and lower limits of the respective alloying elements of the commercially available MRI153 and MRI230 magnesium alloys. For example, in the case of Al, an embodiment is possible in the range of 6.0-8.0 wt % including the lower and upper limits of 6.45 wt % and 7.95 wt %, respectively. That is, an embodiment is possible in the ranges including 6.0-8.0 wt % of Al, 0.8-2.4 wt % of Ca, 0.1-0.3 wt % of Mn, 0.2-0.3 wt % of Sr, less than 0.04 wt % of Zn, and less than 0.9 wt % of Sn. For the embodiment, an added amount of CaO in the present invention is adjusted such that the reduced Ca may be included in the ranges of 0.8 wt % to 2.4 wt % of the final Mg alloy. That is, the added amount of CaO may be adjusted to 1.12-3.36 wt % which is 1.4 times of the amount of Ca.

The total amount of CaO will be added 1.4 times the weight of a final Ca target composition under the assumption that all CaO are reduced into Ca. Herein, for alloying the target amount of Ca using the CaO, the added amount of CaO in the molten magnesium alloy is 1.4 times to 1.7 times the weight of the final Ca target composition. By considering the amount that may not react with the molten magnesium alloy and mix with dross on the surface of the molten magnesium alloy, the amount of CaO may be added 1.4 times to 1.7 times the weight of the final Ca target composition.

Figure 5A:
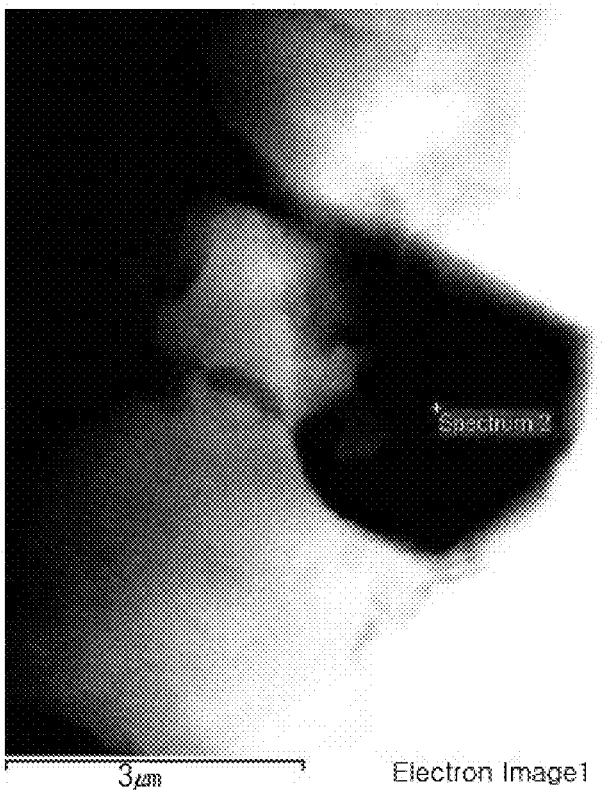
FIGS. 5*a* to 5*d* are transmission electron microscope (TEM) micrographs of a magnesium alloy manufactured by a manufacturing method of a magnesium alloy according to the present invention.
Figure 5B:
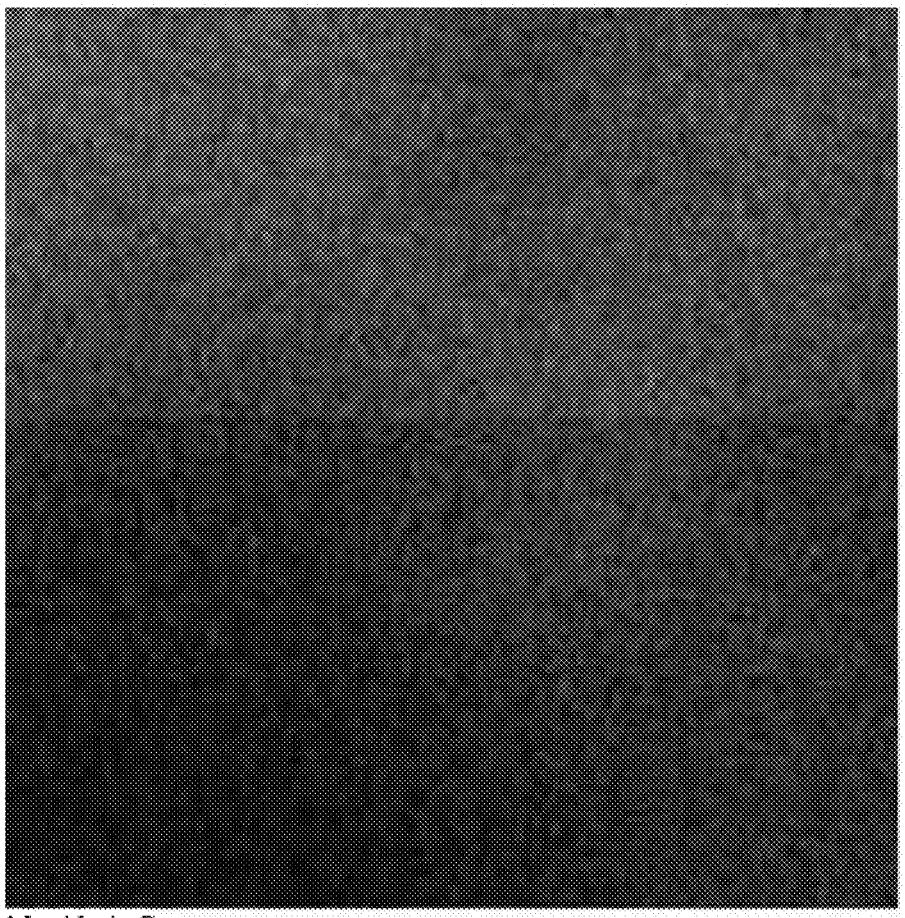
Figure 5C:
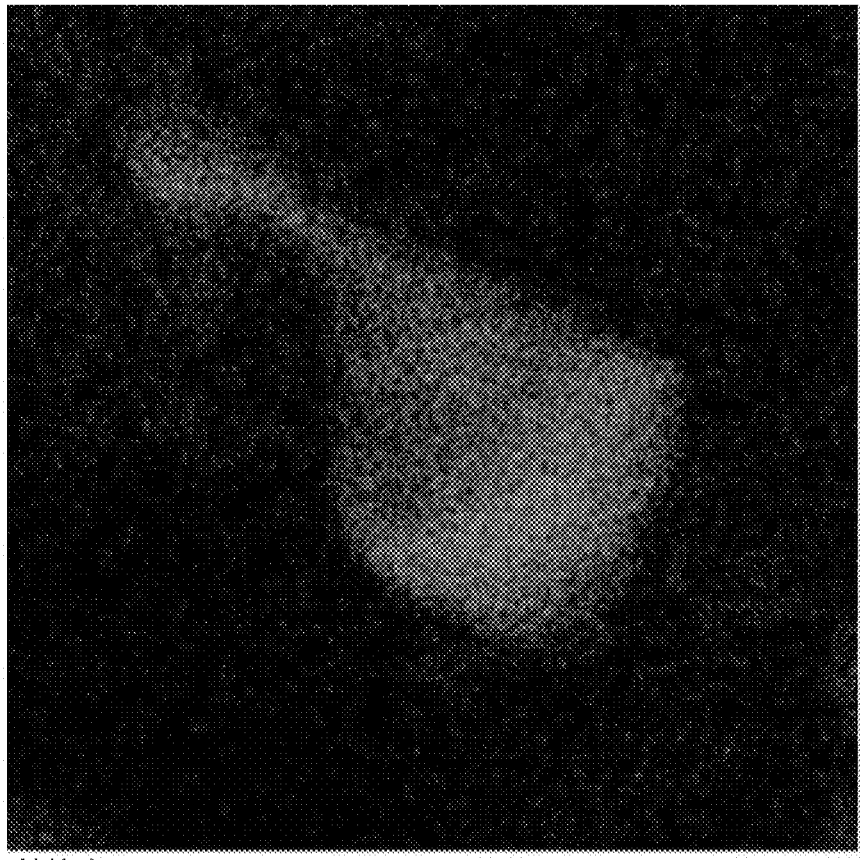
Figure 5D:
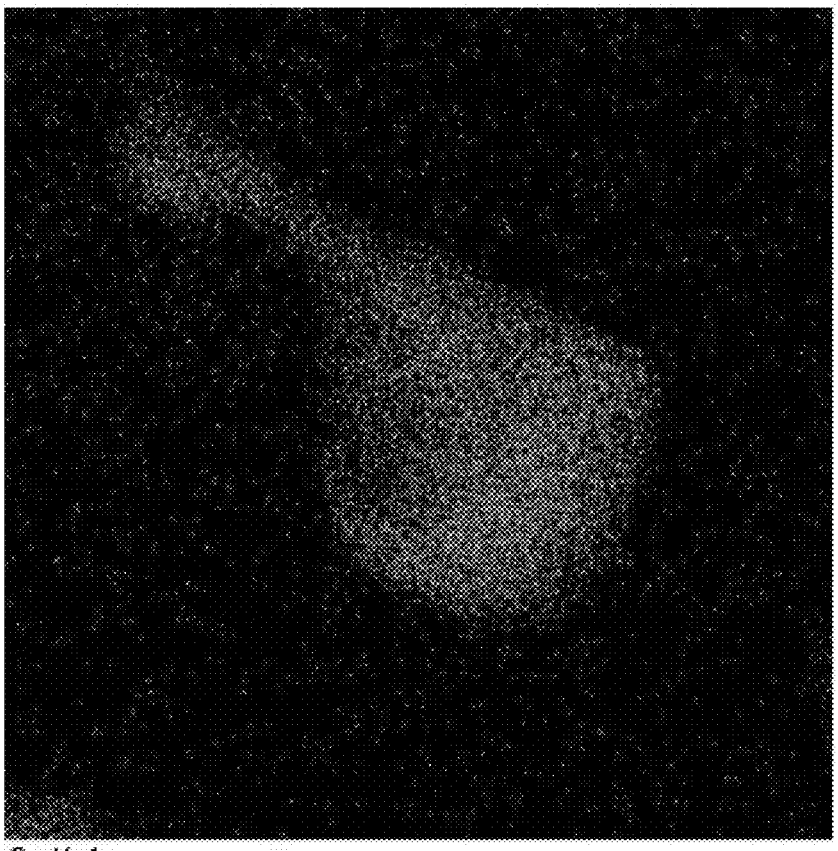

FIGS. 5*a* to 5*d* show compositional analysis of transmission electron microscope (TEM) micrographs of the magnesium alloy manufactured by adding 1.8 wt % of CaO into a AZ61 magnesium alloy by the manufacturing method of the magnesium alloy according to the present invention. FIGS. 5*a*, 5*b* and 5*c* show that magnesium, aluminum and calcium components are detected, respectively. As shown in the micrographs, it can be understood that aluminum and calcium are detected in the same phase. This implies that Ca is dissociated from the CaO added in the molten magnesium and combines with aluminum in the molten magnesium to form a compound.

The following Table 2 presents quantitative data on the composition of the above phase. The compound was formed with Al and Ca, and from a quantitative compositional analysis of the phase, it can be understood that an $Al_2Ca$ phase was formed. High-temperature properties of the magnesium alloy are improved by grain boundary strengthening due to the formation of the $Al_2Ca$ phase and suppressing formation of a thermally unstable $\beta$-$Mg_{17}Al_{12}$ phase. The reason is considered due to the $Al_2Ca$ phases, which are uniformly distributed and formed due to the CaO addition, or other formed phases (e.g., $Mg_2Ca$ and (Mg, Al, other alloying element)$_2$Ca).

TABLE 2

| | wt % | at % |
|---|---|---|
| Al | 68.73 | 76.55 |
| Ca | 31.27 | 23.45 |
| Total | 100 | 100 |

Figure 6:
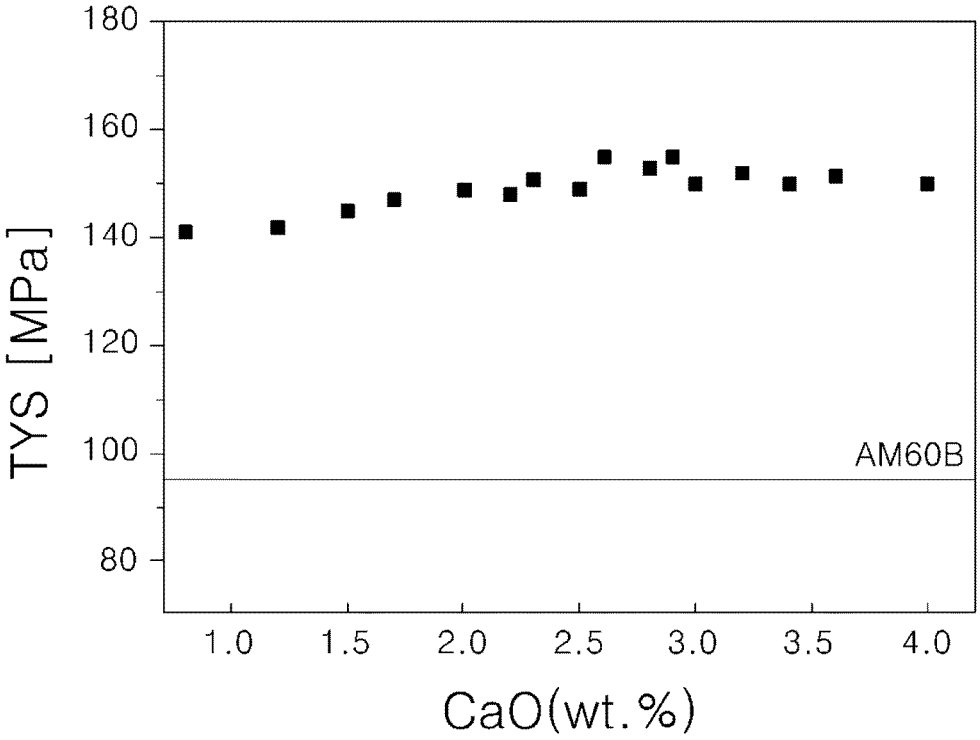
FIG. 6 is a graph showing yield strength measured at 150° C. of magnesium alloys manufactured with varying a CaO content according to the present invention.

FIG. 6 is a graph showing yield strength (TYS) when adding calcium oxide in a magnesium alloy. In the experimental conditions at this time, tensile tests were performed on tensile specimens at a rate of 1 mm/min after holding for 30 minutes at 150° C.

In an exemplary embodiment, the experiments were performed by adding 0.5 wt % to 3.8 wt % of CaO into an AM60B magnesium alloy. For the experiments, Ca was added into the alloy by inducing the reduction reaction caused by additionally adding the CaO into the commercial AM60B alloy.

The yield strength was in the range of 140 MPa to 145 MPa when 0.9 wt % of the calcium oxide was added into the magnesium alloy, and the yield strength was 150 MPa when 1.4 wt % of the calcium oxide was added into the magnesium alloy. When 3.5 wt % of calcium oxide was added into the magnesium alloy, the yield strength was also 150 MPa.

The yield strength according to the added amount (wt %) of CaO is presented in Table 3 below.

TABLE 3

| Alloy | Added amount of CaO | Yield strength [MPa] |
|---|---|---|
| Magnesium alloy (AM60B) | 0.5-0.9 wt % | 141-143 |
| | 1.0-1.4 wt % | 146-151 |
| | 1.5-1.9 wt % | 147-152 |
| | 2.0-2.5 wt % | 150-155 |
| | 2.6-3.2 wt % | 150 |
| | 3.3-3.8 wt % | 150-152 |

In Table 3, the yield strength, which is capable of being used at a high temperature of 90° C., is obtained at 0.5-0.9 wt % of the CaO, and a high-temperature characteristic, which is appropriate for a temperature of 150° C. or more, is obtained at more than the above content of the CaO. That is, it can be understood that the yield strength is relatively better at high temperature when 1.0-3.5 wt % of the calcium oxide is added into the magnesium alloy.

Figure 7:
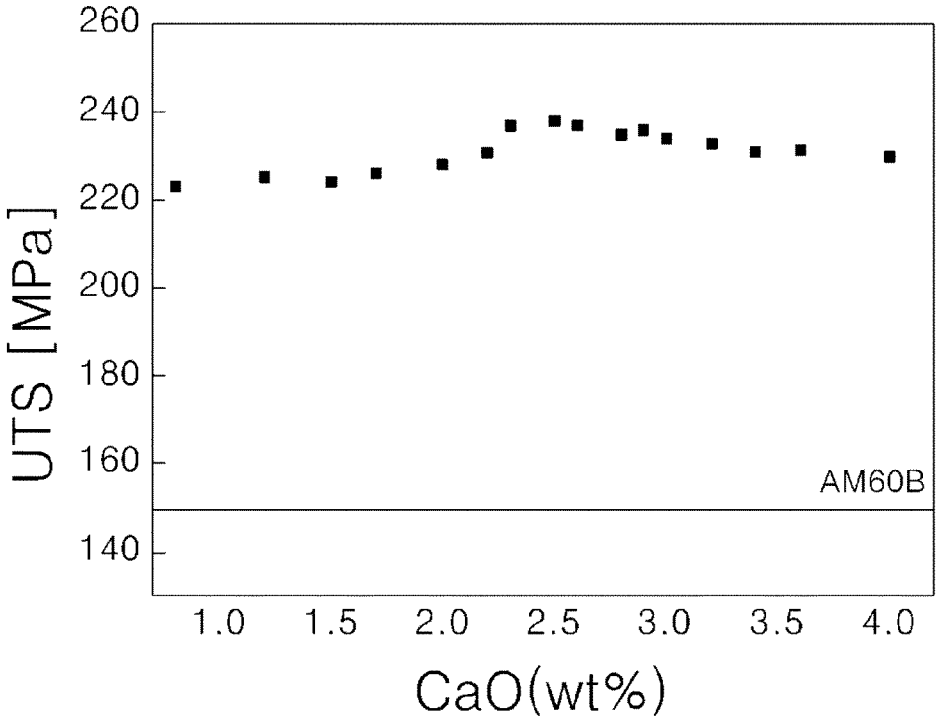
FIG. 7 is a graph showing tensile strength measured at 150° C. of magnesium alloys manufactured with varying a CaO content according to the present invention.

FIG. 7 is a graph showing tensile strength (UTS) when adding the calcium oxide in the magnesium alloy. In the experimental conditions at this time, tensile tests are performed on tensile specimens at a rate of 1 mm/min after holding for 30 minutes at 150° C.

In an exemplary embodiment, the experiments were performed by adding the CaO in the range of 0.5 wt % to 3.8 wt % into an AM60B magnesium alloy. For the experiments, Ca was added into the alloy by inducing the reduction reaction caused by additionally adding the CaO into the commercial AM60B alloy.

The tensile strength was 225 MPa when 0.9 wt % of the calcium oxide was added into the magnesium alloy, and the tensile strength was 239 MPa when 1.4 wt % of the calcium oxide was added into the magnesium alloy. When 3.5 wt % of the calcium oxide was added into the magnesium alloy, the tensile strength was 232 MPa.

The tensile strength according to the added amount (wt %) of CaO is presented in Table 4 below.

TABLE 4

| Alloy | Added amount of CaO | Tensile strength [MPa] |
|---|---|---|
| Magnesium alloy (AM60B) | 0.5-0.9 wt % | 222-224 |
| | 1.0-1.4 wt % | 225-230 |
| | 1.5-1.9 wt % | 232-238 |
| | 2.0-2.5 wt % | 234-239 |
| | 2.6-3.2 wt % | 232 |
| | 3.3-3.8 wt % | 230-232 |

In Table 4, the tensile strength, which is capable of being used at a high temperature of 90 !E, is obtained at 0.5-0.9 wt % of the CaO, and a high-temperature characteristic, which is appropriate for a temperature of 150 !E or more, is obtained at more than the above content of the CaO. That is, it can be understood that the tensile strengths are relatively better at high temperature when 1.0-3.5 wt % of the calcium oxide is added into the magnesium alloy.

Figure 8:
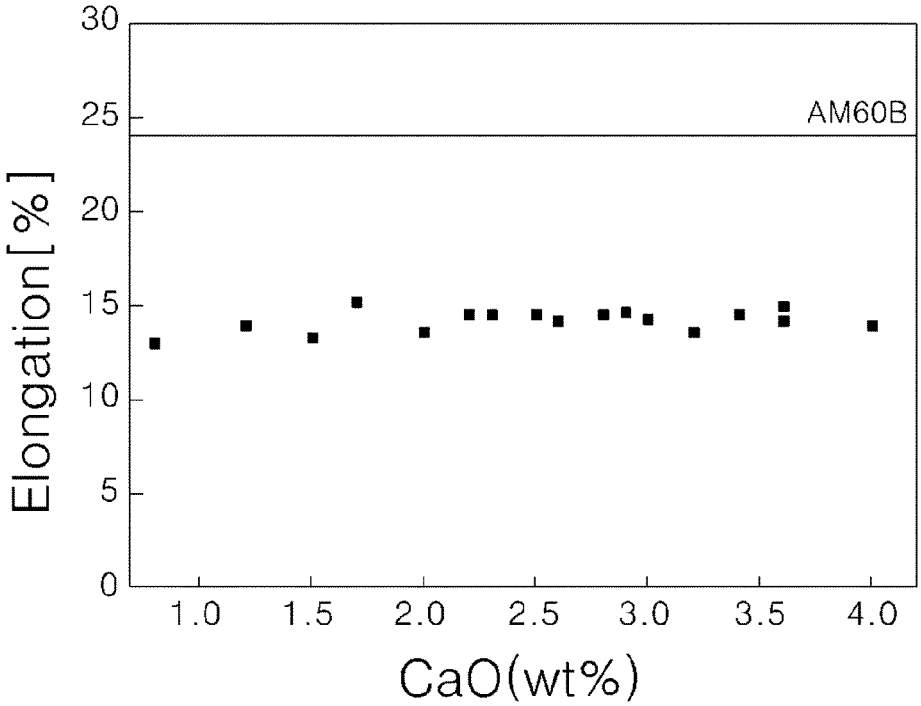
FIG. 8 is a graph showing elongation measured at 150° C. of magnesium alloys manufactured with varying a CaO content according to the present invention.

FIG. 8 is a graph showing elongation when adding the calcium oxide in the magnesium alloy. In the experimental conditions at this time, tensile tests were performed on tensile specimens at a rate of 1 mm/min after holding for 30 minutes at 150 !E.

In an exemplary embodiment, the experiments were performed by adding the CaO in the range of 0.5 wt % to 3.8 wt % into an AM60B magnesium alloy. For the experiments, Ca was added into the alloy by inducing the reduction reaction caused by additionally adding the CaO into the commercial AM60B alloy.

As shown in FIG. 8, the elongation obtained was in the range of 13% to 14% when 0.9 wt % of the calcium oxide was added into the magnesium alloy, and the elongation obtained was in the range of 14% to 15% when 1.4 wt % of the calcium oxide was added into the magnesium alloy. When 3.5 wt % of the calcium oxide was added into the magnesium alloy, the elongation was 14%.

The elongation depending on the CaO wt % is presented in the following Table 5.

TABLE 5

| Alloy | Added amount of CaO | Elongation [%] |
|---|---|---|
| Magnesium alloy (AM60B) | 0.5-0.9 wt % | 13-14 |
| | 1.0-1.4 wt % | 14-15 |
| | 1.5-1.9 wt % | 15 |
| | 2.0-2.5 wt % | 14-15 |
| | 2.6-3.2 wt % | 15 |
| | 3.3-3.8 wt % | 14-15 |

Figure 9:
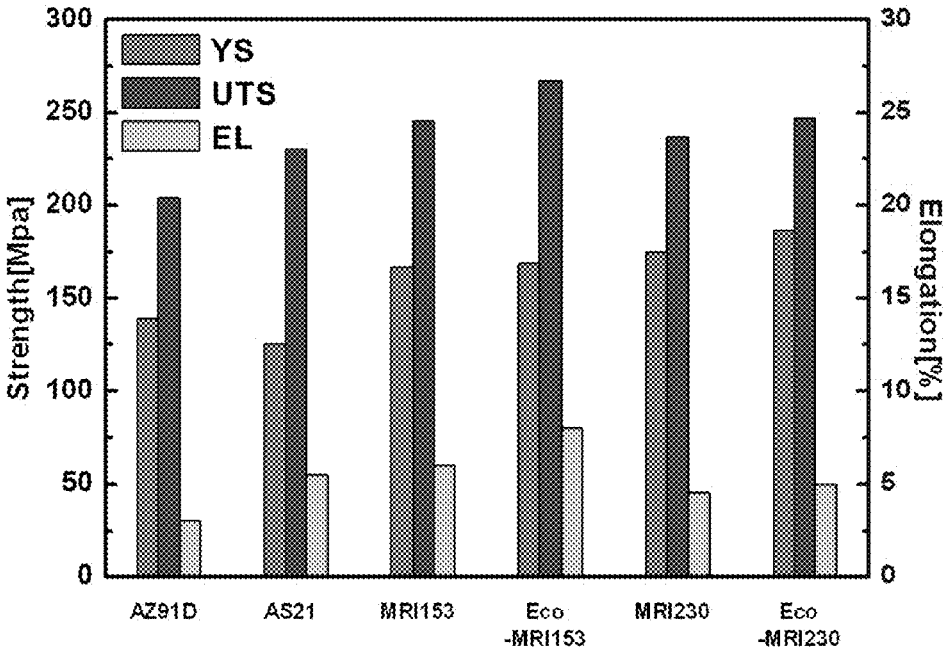
FIG. 9 is a graph showing room-temperature mechanical properties of MRI153 and MRI230 (Eco-MRI153 and Eco-MRI230) manufactured using CaO, compared to those of MRI153 and MRI230 Mg alloys manufactured using Ca.

FIG. 9 is a graph comparing room-temperature mechanical properties between Mg alloys having compositions of the Eco-MRI153 and the Eco-MRI230 manufactured using CaO and Mg alloys having compositions of the MRI153 and the MRI230 manufactured using Ca.

As shown in FIG. 9, it was found that the magnesium-based alloy for high temperature (the Eco-MRI153 and the Eco-MRI230) according to the present invention exhibit superior yield strength (YS), tensile strength (UTS) and elongation to the MRI153 and the MRI230 even at room temperature. That is, the Eco-MRI153 and the Eco-MRI230 have better room-temperature mechanical properties than the MRI153 and the MRI230 manufactured using Ca.

Figure 10:
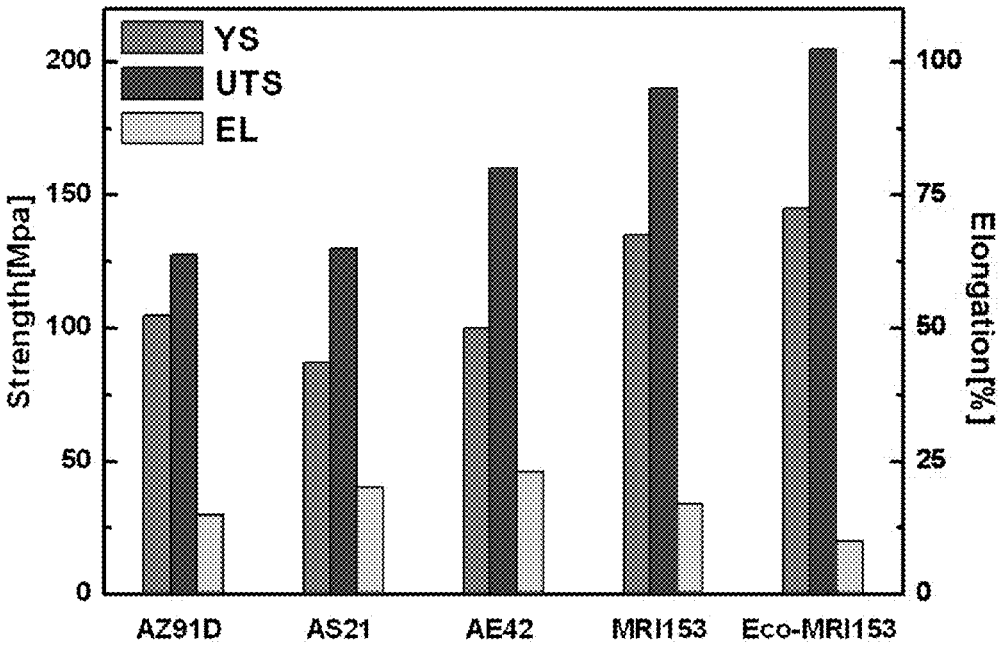
FIG. 10 is a graph showing high-temperature (150° C.) mechanical properties between MRI153 manufactured using CaO and MRI153 using Ca.

FIG. 10 is a graph comparing high-temperature mechanical properties of Mg alloys between the MRI153 alloy manufactured using CaO and the MRI153 alloy using Ca.

As shown in FIG. 10, it was found that the magnesium-based alloy (the Eco-MRI153) according to the present invention exhibit superior yield strength and tensile strength to the MRI153 even at high temperature (150° C.). In the case of high-temperature elongation, the Eco-MRI153 of the present invention was smaller than the MRI153. It can be understood that changes in the elongation are small at high temperature so that the magnesium-based alloy according to the present invention has stable mechanical properties even for temperature changes. That is, the magnesium-based alloy manufactured using the CaO according to the present invention has good elongation as well as good yield strength and tensile strength even at high temperature.

Figure 11:
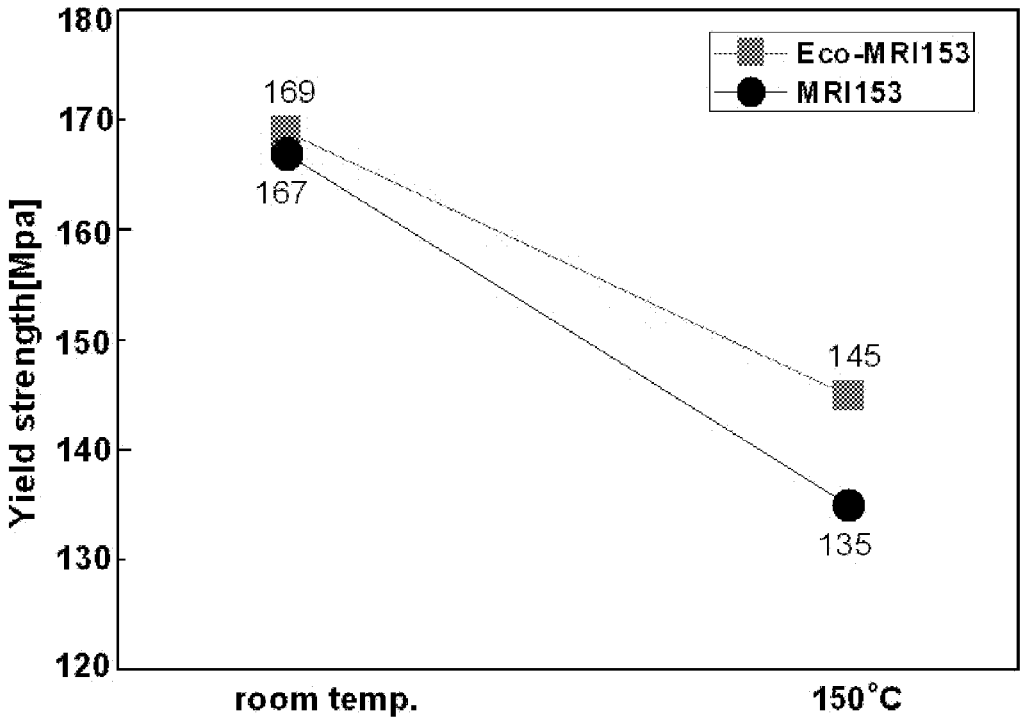
FIG. 11 is a graph comparing yield strength at room and high temperature between an MRI153 (Eco-MRI153) magnesium alloy in which a composition is adjusted by adding CaO according to the present invention, and an MRI153 alloy in which a composition is adjusted by adding Ca according to a comparative example.

FIG. 11 is a graph comparing yield strength at room and high temperature between an Eco-MRI153 magnesium alloy in which a Ca composition is indirectly adjusted by adding CaO and an MRI153 magnesium alloy in which a composition is adjusted by directly adding Ca. It can be understood that in the case of the Eco-MRI153, high-temperature yield strength is increased 8% as compared to the MRI153.

Figure 12:
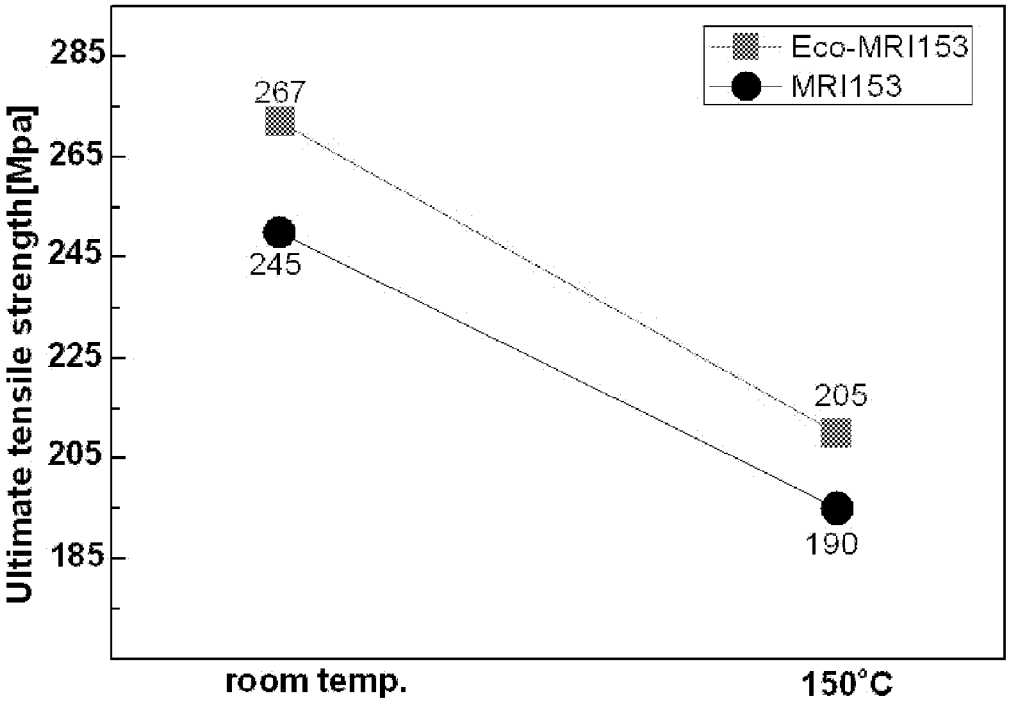
FIG. 12 is a graph comparing tensile strength at room and high temperature between an MRI153 (Eco-MRI153) alloy in which a composition is adjusted by adding CaO according to the present invention, and an MRI153 magnesium alloy in which a composition is adjusted by adding Ca according to a comparative example.

FIG. 12 is a graph comparing tensile strength at room and high temperature between an Eco-MRI153 magnesium alloy in which a Ca composition is indirectly adjusted by adding CaO and an MRI153 magnesium alloy in which a composition is adjusted by adding Ca. It can be understood that the Eco-MRI153 manufactured by adding the CaO has higher yield and tensile strengths at room and high temperature (150° C.) than the MRI153 having the same composition manufactured by directly adding the Ca. It can be understood that in the case of the Eco-MRI153, high-temperature tensile strength is increased 8% as compared to the MRI153. Particularly, in the case of the high-temperature tensile strength in FIG. 11, a remarkable improvement may be confirmed in the Eco-MRI153 adjusting the composition with the CaO according to the present invention.

Figure 13:
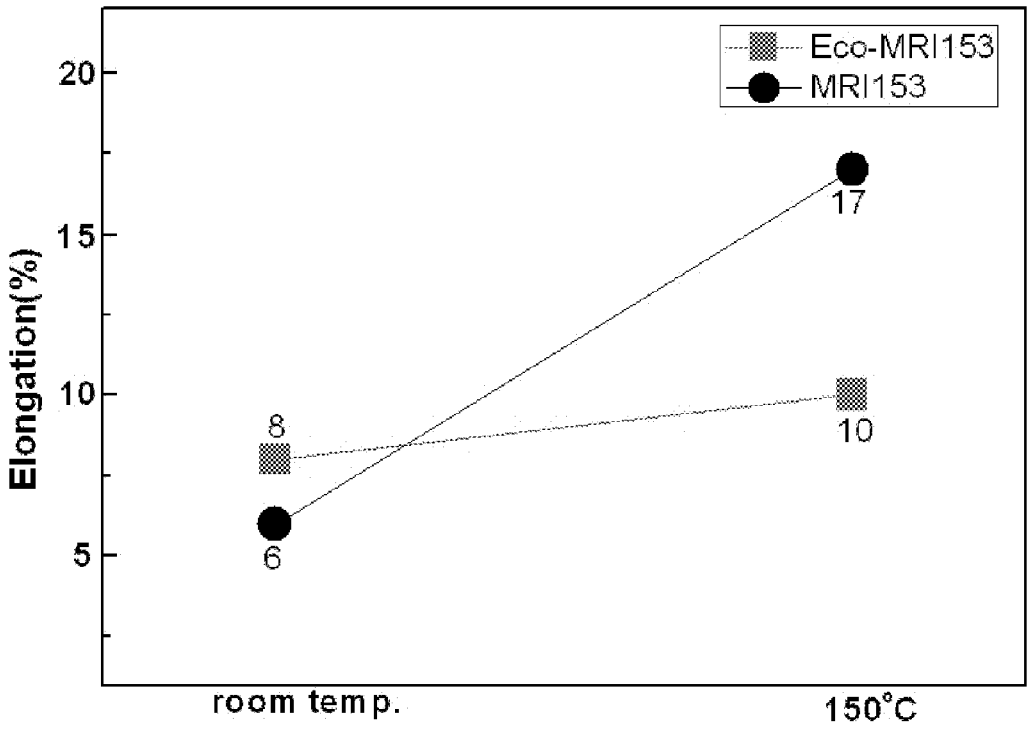
FIG. 13 is a graph comparing elongation at room and high temperature between an MRI153 (Eco-MRI153) alloy in which a composition is adjusted by adding CaO according to the present invention, and an MRI153 magnesium alloy in which a composition is adjusted by adding Ca according to a comparative example.

FIG. 13 is a graph comparing elongation at room and high temperature between an Eco-MRI153 magnesium alloy in which a Ca composition is indirectly adjusted by adding CaO and an MRI153 magnesium alloy in which a composition is adjusted by adding Ca.

In the case of the elongation at room temperature, elongation of the Eco-MRI153 manufactured by adding the CaO was higher than that of the MRI153 having the same composition manufactured by directly adding the Ca. On the other hand, at high temperature, the elongation of the Eco-MRI153 manufactured by adding the CaO was lower than the case of directly adding the Ca. It can be understood that in the case of the Eco-MRI153, high-temperature elongation is decreased 42% as compared to the MRI153. Particularly, the high-temperature elongation at 150° C. was remarkably low in the Eco-MRI153 adjusting the composition by adding the CaO. That is, changes in the elongation depending on the temperature were smaller in the Eco-MRI153 manufactured by adding the CaO than the MRI153 manufactured by directly adding the Ca.

Figure 14:
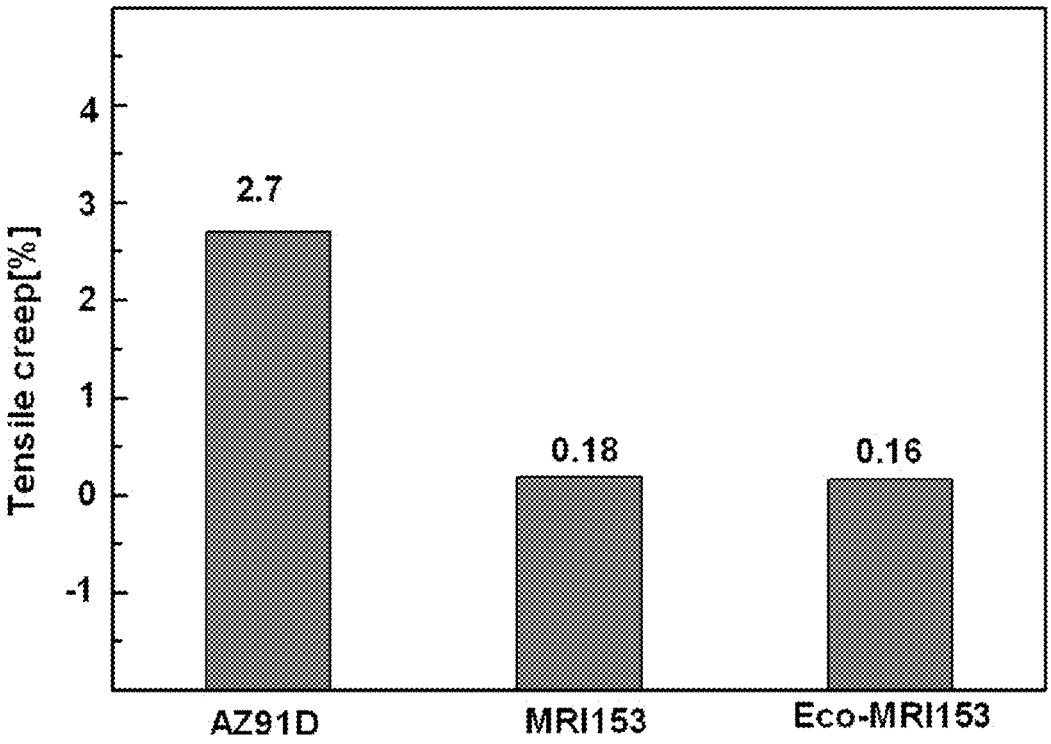
FIG. 14 is a graph comparing creep strain (200 hr, 50 MPa and 150° C.) between an MRI153 (Eco-MRI153) alloy in which a composition is adjusted by adding CaO according to the present invention, and an MRI153 magnesium alloy in which a composition is adjusted by adding Ca according to a comparative example.

FIG. 14 is a graph comparing creep strain (200 hr, 50 MPa and 150° C.) between an Eco-MRI153 magnesium alloy in which a composition is indirectly adjusted by adding CaO according to the present invention, and an MRI153 magnesium alloy in which a composition is adjusted by adding Ca according to a comparative example.

Creep resistance was better in the Eco-MRI153 alloy manufactured by adding the CaO than the commercial MRI153 alloy manufactured by adding the Ca. That is, creep strain (elongation) was smaller in the Eco-MR153 alloy.

Figure 15:
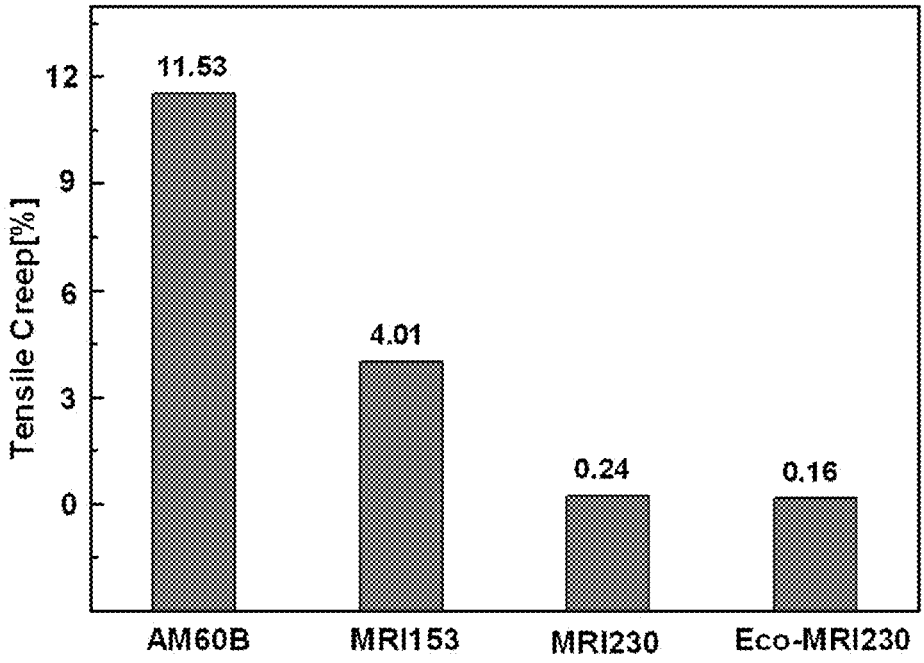
FIG. 15 is a graph comparing creep strain (200 hr, 70 MPa and 175° C.) between an MRI230 (Eco-MRI230) alloy in which a composition is adjusted by adding CaO according to the present invention, and an MRI230 magnesium alloy in which a composition is adjusted by adding Ca according to a comparative example.

FIG. 15 is a graph comparing creep strain (200 hr, 70 MPa and 175° C.) between an MRI153 (Eco-MRI153) alloy in which a composition is adjusted by adding CaO according to the present invention, and an MRI153 magnesium alloy in which a composition is adjusted by adding Ca according to a comparative example.

Creep resistance at the high temperature was better in the Eco-MRI230 alloy manufactured by adding the CaO than the commercial MRI230 alloy manufactured by adding the Ca. That is, creep strain was smaller in the Eco-MR230 alloy.

As described above, when CaO is added into the commercial magnesium alloy in the present invention, it is consequently possible to alloy Ca indirectly. Therefore, the results show that high-temperature physical properties of the magnesium alloy are improved. Microstructure of the magnesium alloy manufactured by the CaO addition becomes finer, and $Mg_2Ca$, $Al_2Ca$ or $(Mg, Al)_2Ca$ phases are formed uniformly. Formation of a thermally unstable $\beta$-$Mg_{17}Al_{12}$ phase is suppressed, and casting defects are remarkably reduced. As a result, yield strength and tensile strength of the magnesium alloy at high temperature are increased. In the case of elongation, rapid increase in the elongation at high temperature is suppressed unlike typical magnesium alloys. That is, high-temperature elongation and creep strain are decreased, and therefore, high-temperature creep strength is increased.

While this invention has been particularly shown and described with reference to preferred embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A method of manufacturing a magnesium-based alloy, the method comprising:

melting magnesium (Mg) or magnesium alloy into a liquid phase;

adding 0.5% to 4.0% by weight of calcium oxide (CaO) onto a surface of a melt in which the magnesium or magnesium alloy is melted;

exhausting the CaO to allow the CaO not to at least substantially remain in the magnesium or magnesium alloy through a surface reduction reaction between the melt and the CaO; and forming a compound by reacting at least a portion of calcium (Ca) produced by the surface reduction reaction in the magnesium or magnesium alloy, wherein the surface reduction reaction in the magnesium or magnesium alloy includes stirring an upper layer portion of the melt, the upper layer portion having a depth from the surface thereof, the depth of the upper layer portion being no more than 20% of a total depth of the melt.

2. The method of claim 1, comprising adding the CaO with a weight corresponding to 1.4 times a weight of a target weight of Ca in a final magnesium alloy onto the surface of the melt in which the magnesium or the magnesium alloy is melted.

3. The method of claim 1, wherein the CaO is added in the range of 1.0-3.5 wt %.

4. The method of claim 1, wherein the Ca is produced in the range of 0.8-2.4 wt %.

5. The method of claim 4, wherein a final composition of the Mg alloy comprises 6.0-8.0 wt % of aluminum (Al), 0.1-0.3 wt % of manganese (Mn), 0.2-0.3 wt % of strontium (Sr), less than 0.04 wt % of zinc (Zn), less than 0.9 wt % of tin (Sn), and a balance being Mg.

6. The method of claim 1, wherein the compound formed comprises at least one of $Mg_2Ca$, $Al_2Ca$ and $(Mg, Al)_2Ca$.

7. The method of claim 1, wherein the depth of the upper layer portion is about 10% of the total depth of the melt.

* * * * *